US006307531B1

(12) United States Patent
Shin

(10) Patent No.: US 6,307,531 B1
(45) **Date of Patent: *Oct. 23, 2001**

(54) LIQUID CRYSTAL DISPLAY HAVING DRIVING INTEGRATED CIRCUITS IN A SINGLE BANK

(75) Inventor: Min-Cheol Shin, Kumi-si (KR)

(73) Assignee: LG. Philips LCD Co., Ltd., Seoul (KR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/134,083

(22) Filed: Aug. 14, 1998

(30) Foreign Application Priority Data

Aug. 16, 1997 (KR) ..... 97-39055

(51) Int. Cl.[7] ..... G09G 3/36

(52) U.S. Cl. ..... 345/88; 345/150; 345/213; 345/98

(58) Field of Search ..... 345/87–88, 90, 345/94, 92, 96, 98–99, 100, 152, 213, 211, 507–508, 204, 150

(56) References Cited

U.S. PATENT DOCUMENTS 5,719,591 * 2/1998 Callahan, Jr. et al. ..... 345/98
5,790,096 * 8/1998 Hill, Jr. ..... 345/150
5,796,379 * 8/1998 Enomoto et al. ..... 345/89
5,856,818 * 1/1999 Oh et al. ..... 345/99

* cited by examiner

*Primary Examiner*—Richard Hjerpe
*Assistant Examiner*—Francis Nguyen
(74) *Attorney, Agent, or Firm*—Long Aldridge & Norman LLP

(57) ABSTRACT

A liquid crystal display apparatus having driving integrated circuits arranged in a single bank form that is adapted to respond to video data for double bank while enlarging the effective display area thereof. The driving integrated circuits are arranged in parallel in one region of a liquid crystal panel to drive the pixels contained in a pixel matrix in the liquid crystal panel. Also, the driving integrated circuits divisionally drive pixels for one line in a predetermined number of pixel units arranged successively with the video data having odd-numbered pixel data and even-numbered pixel data sequentially rearranged.

9 Claims, 5 Drawing Sheets

LIQUID CRYSTAL DISPLAY HAVING DRIVING INTEGRATED CIRCUITS IN A SINGLE BANK

BACKGROUND OF THE INVENTION

1. Field of the Invention

This invention relates to a liquid crystal display apparatus that displays a picture employing a liquid crystal cell matrix, and more particularly to a liquid crystal display apparatus wherein the liquid crystal cell matrix is driven with driving integrated circuits (D-ICs) arranged in a single bank form.

2. Description of the Prior Art

Generally, a liquid crystal display apparatus displays pictures for video signals by controlling the light transmissivity of a liquid crystal. To this end, the conventional liquid crystal display apparatus includes a liquid crystal panel having picture elements or pixels arranged in a matrix form, and driving integrated circuits (D-ICs) for driving the pixel matrix defined on the liquid crystal panel. Each pixel arranged in the matrix form consists of liquid crystal cells and thin film transistors (TFTs). The D-ICs are arranged on the liquid crystal panel in a double bank form to divisionally drive the pixel matrix. More specifically, one side bank of the D-ICs drives odd-numbered pixels while the other side bank thereof drives even-numbered pixels. Accordingly, video data are divided into two groups in accordance with locations of pixels and supplied to the two D-IC banks.

For example, the conventional liquid crystal display apparatus having D-ICs arranged in a double bank form, hereinafter referred to as "double bank liquid crystal display apparatus," takes a configuration as shown in FIG. 1. Referring to FIG. 1, first and second D-IC banks 12 and 14 are spatially arranged in the upper portion and the lower portion of a liquid crystal panel 10, respectively. The first D-IC bank 12 drives odd-numbered pixels, i.e., first red and blue color pixels, and a second green color pixel, of the pixels contained in a pixel matrix 16 spatially arranged in the center of the liquid crystal panel 10. Similarly, the second D-IC bank 14 drives even-numbered pixels, i.e., a first green pixel, and second red and blue pixels, of the pixels contained in the pixel matrix 16. To this end, video signals are formatted into a first bank data group including odd-numbered red and blue pixel data and even-numbered green pixel data, and a second bank data group, including odd-numbered green pixel data and even-numbered red and blue pixel data.

The double bank liquid crystal display apparatus as mentioned above has a disadvantage in that an effective field area, that is, an area occupied by the pixel matrix 16, is reduced because the two D-IC banks 12 and 14 occupy a large area. In other words, the apparatus has a disadvantage in that it requires a larger glass substrate for use in the liquid crystal panel.

As an alternative for solving such a disadvantage in the double bank liquid crystal display apparatus, there has been suggested a single bank type liquid crystal display apparatus in which D-ICs are spatially arranged in one side of the liquid crystal panel. In the single bank liquid crystal display apparatus, as shown in FIG. 2, the liquid crystal panel 20 includes a D-IC bank 22 having D-ICs, not shown, arranged in a line, and a pixel matrix 24 driven with the D-IC bank 22. The D-IC bank 22 includes first to sixth data buses DL1 to DL6 to drive the pixel matrix 24 with the video data configured for the double bank form. The D-IC bank 22 receives from the first to sixth data buses DL1 to DL6 six pixel data for displaying 6 adjacent pixels in every clock period. In other words, as shown in FIG. 3, the D-IC bank 22 receives 6 pixel data to be displayed for the first red pixel, first green pixel, first blue pixel, second red pixel, second green pixel and second blue pixel in the first clock period, and receives 6 pixel data to be displayed for third red pixel, third green pixel, third blue pixel, fourth red pixel, fourth green pixel and fourth blue pixel in the second clock period.

In order to process 6 pixel data to be displayed for 6 adjacent pixels in a single clock period, two D-ICs must be simultaneously driven. This results in a complication in the wiring between the D-ICs and the pixel matrix as well as a difficulty in an enhancement of effective display area in the liquid crystal panel. In other words, the single bank liquid crystal display apparatus shown in FIG. 2 is incapable of reducing the size of liquid crystal panel below a certain limit.

SUMMARY OF THE INVENTION

Accordingly, it is an object of the present invention to provide a liquid crystal display apparatus having D-ICs arranged in a single bank form that is adapted to respond to video data signal bank form while enlarging the effective display area thereof.

Further object of the present invention is to provide a liquid crystal display apparatus having D-ICs arranged in a single bank form that is adapted to respond to a high rate video data signal for double bank while enlarging the effective display area thereof.

In order to achieve these and other objects of the invention, a liquid crystal display apparatus according to one embodiment of the present invention comprises a pixel matrix having pixels arranged on a liquid crystal panel in a matrix form, first input means for sequentially receiving odd-numbered pixel data to be displayed on odd-numbered pixels of the pixels contained in the pixel matrix, second input means for sequentially receiving even-numbered pixel data to be displayed on even-numbered pixels of the pixels contained in the pixel matrix, a plurality of driving circuits, arranged in parallel, for driving the pixels contained in the pixel matrix in line units, and for divisionally driving pixels for one line in a certain number of pixel units arranged successively, and means for sequentially rearranging odd-numbered pixel data from the first input means and even-numbered pixel data from the second input means, and for supplying the rearranged pixel data to the plurality of driving circuits.

A liquid crystal display apparatus according to another embodiment of the present invention comprises a pixel matrix having pixels arranged on a liquid crystal panel in a matrix type, first input means for sequentially receiving odd-numbered pixel data to be displayed on odd-numbered pixels of the pixels contained in the pixel matrix, second input means for sequentially receiving even-numbered pixel data to be displayed on even-numbered pixels of the pixels contained in the pixel matrix, a plurality of driving circuits, arranged in parallel, for driving the pixels contained in the pixel matrix in line units, and for divisionally driving pixels for one line in a certain number of pixel units arranged successively, means for sequentially rearranging odd-numbered pixel data from the first input means and even-numbered pixel data from the second input means, and for supplying the rearranged pixel data to the plurality of driving circuits, and block driving means for dividing the rearranged pixel data from the rearranging means a plurality of block data corresponding to the number of driving circuits, and for distributively supplying the plurality of block data, via at least two transfer paths, to at least two group of driving circuits simultaneously.

BRIEF DESCRIPTION OF THE DRAWINGS

These and other objects of the invention will be apparent from the following detailed description of the embodiments of the present invention with reference to the accompanying drawings.

DETAILED DESCRIPTION OF THE PREFERRED EMBODIMENT

Figure 1:
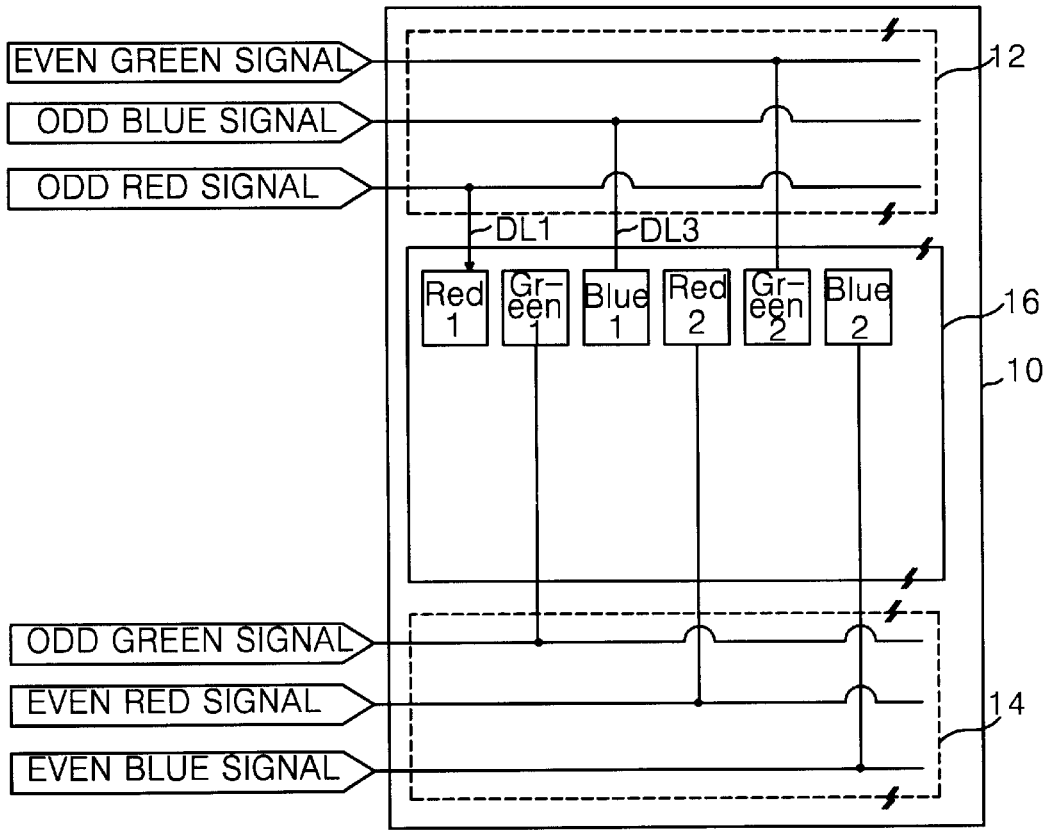
FIG. 1 PRIOR ART
FIG. 1 is a schematic diagram showing a conventional double bank liquid crystal display apparatus.
Figure 2:
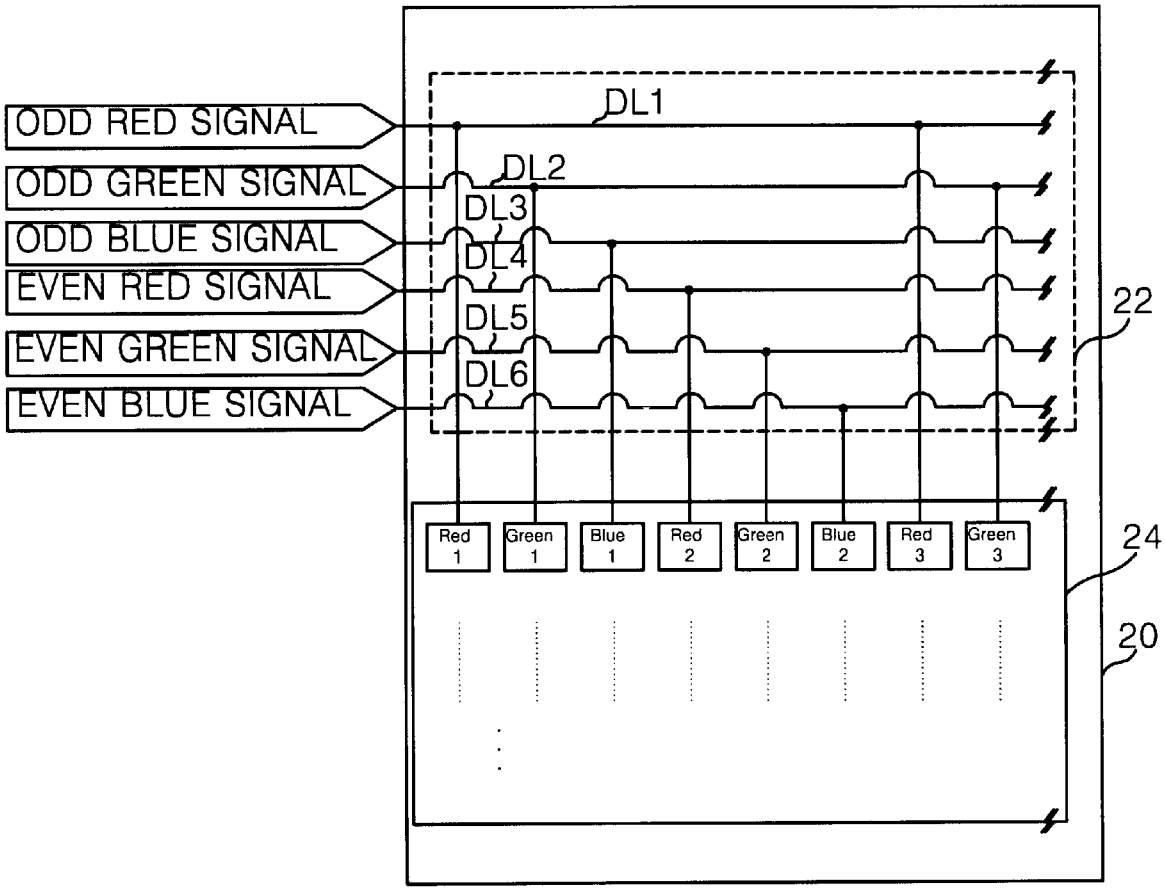
FIG. 2 PRIOR ART
FIG. 2 is a schematic diagram showing a conventional single bank liquid crystal display apparatus.
Figure 3:
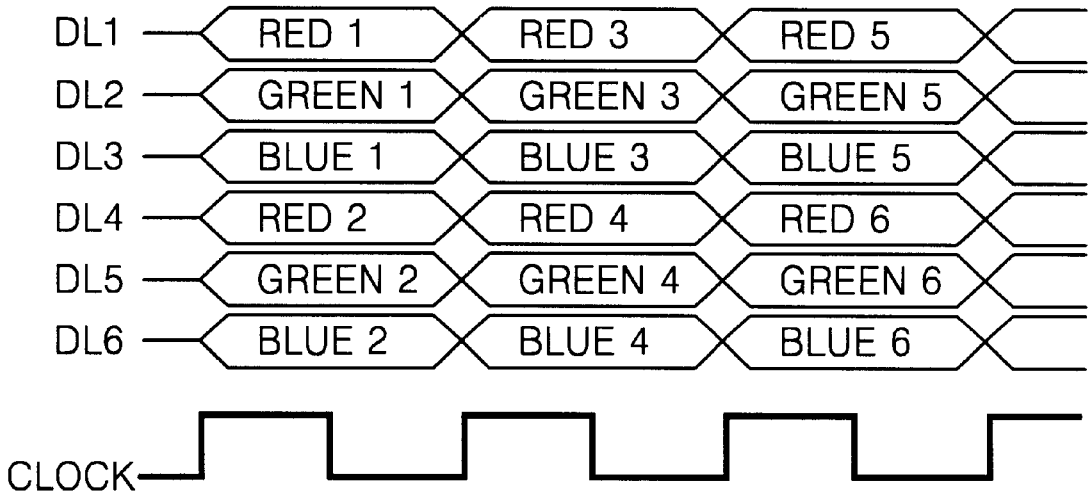
FIG. 3 illustrates a format of video data for the double bank.
Figure 4:
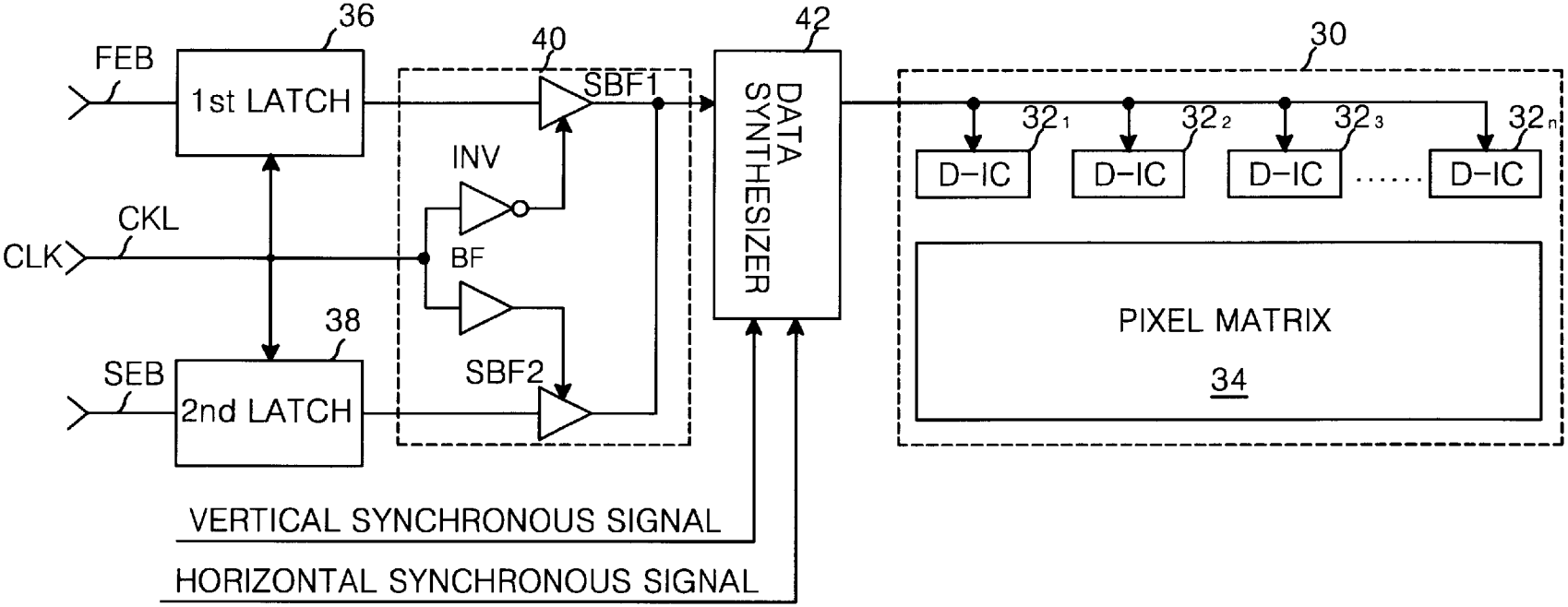
FIG. 4 is a schematic diagram showing a single bank liquid crystal display apparatus according to a first embodiment of the present invention.

Referring to FIG. 4, there is shown a liquid crystal display apparatus according to a first embodiment of the present invention that includes first to nth D-ICs $\mathbf{32}_1$, to $\mathbf{32}_n$ spatially arranged in parallel preferably in the upper region of the liquid crystal panel 30 and further includes a pixel matrix 34 preferably provided in the lower region. The n D-ICs $\mathbf{32}_1$, to $\mathbf{32}_n$ divide pixels in the horizontal axis into 1/n units and drive them sequentially. In other words, each of the D-ICs $\mathbf{32}_1$, to $\mathbf{32}_n$ drives the pixels arranged successively.

The liquid crystal display apparatus further includes a first latch 36, a second latch 38 and a multiplexer 40 that respond to a clock signal CLK from a clock input line CKL, and a data synthesizer 4 connected between the multiplexer 40 and the D-ICs $\mathbf{32}_1$, to $\mathbf{32}_n$. The first latch 36 latches the odd-numbered red, green and blue pixel data inputted from a first external bus FEB into the multiplexor 40 each time the clock signal CLK from the clock input line CKL changes from a high logic to a low logic. Likewise, the second latch 28 latches the even-numbered red, green and blue pixel data inputted from the a second external bus SEB into the multiplexor 40 each time the clock signal CLK from the clock input line CKL changes from a high logic to a low logic.

The multiplexer 40 transfers the odd-numbered red, green and blue pixel data from the first latch 36 or the even-numbered red, green and blue pixel data from the second latch 38 to the data synthesizer 42 depending upon a logical value of the clock signal CLK of the clock input line CKL.

The multiplexer 40 includes a first three-state buffer SBF1 connected between the first latch 36 and the data synthesizer 42, a second three-state buffer SBF2 connected between the second latch 38 and the data synthesizer 42, and an inverter INV and a buffer BF for commonly receiving the clock signal CLK from the clock input line CKL. The inverter INV inverts the clock signal CLK from the clock input line CKL and applies the inverted clock signal to the control terminal of the first three-state buffer SBF1. The buffer BF buffers the clock signal CLK from the clock input line CKL and applies the buffered clock signal to the control terminal of the second three-state buffer SBF2.

The first three-state buffer SBF1 delivers the odd-numbered red, green and blue pixel data from the first latch 36 into the data synthesizer 42 when the inverted clock signal from the inverter INV remains at a high logic. On the other hand, the second three-state buffer SBF2 delivers the even-numbered red, green and blue pixel data from the second latch 38 into the data synthesizer 42 when the buffered clock signal from the buffer BF remains at a high logic. In other words, the first and the second three-state buffers SBF1 and SBF2 complementarily performs the transferring operation in accordance with a logical state of the clock signal CLK on the clock input line CKL, hence sequentially generating the video data rearranged into the odd-numbered and the even-numbered video data.

The video data outputted from the first and the second three-state buffers SBF1 and SBF2 have a time period corresponding to one-half of a clock period. The data synthesizer 42 receiving the sequentially rearranged video data from the multiplexor 40 supplies the video data to the first to nth D-ICs $\mathbf{32}_1$, to $\mathbf{32}_n$ in conformity with the vertical and horizontal synchronous signals. Then, the 1st to nth D-ICs $\mathbf{32}_1$, to $\mathbf{32}_n$, are sequentially driven to receive 1/n units of video data for one line, and divisionally drive the 1/n units of pixels for one line with the received video data. In this point of view, the data synthesizer 42 can include a controlled amplifier or buffer responding to the vertical and horizontal synchronous signals. The controlled amplifier or buffer is operated at horizontal scanning period by the vertical and horizontal synchronous signals. Consequently, the vertical and horizontal synchronous signals are inserted in the video data by the data synthesizer 42.

As described above, in the liquid crystal display apparatus according to the first embodiment of the present invention, the odd-numbered pixel data and the even-numbered pixel data are sequentially rearranged by means of two latches 36 and 38 and a multiplexor 40, thereby allowing the D-ICs to divide and sequentially drive the pixels for one line in a predetermined pixel units. Accordingly, the apparatus is capable of simplifying the wiring between the pixel matrix and the D-ICs as well as relatively enlarging the effective display area, that is, the area occupied by the pixel matrix. In other words, in the present invention, it becomes possible to reduce the size of liquid crystal panel.

Figure 5:
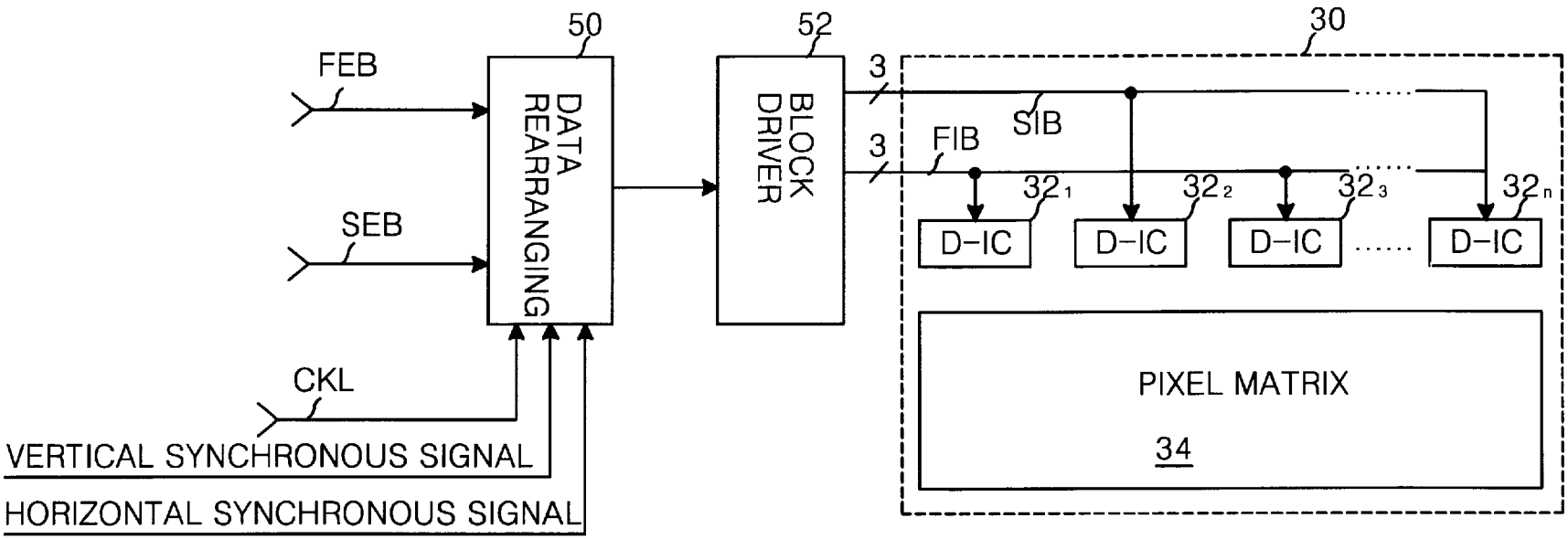
FIG. 5 is a schematic diagram showing a single bank liquid crystal display apparatus according to a second embodiment of the present invention.

Referring to FIG. 5, there is shown a liquid crystal display apparatus according to a second embodiment of the present invention which includes 1st to nth D-ICs $\mathbf{32}_1$, to $\mathbf{32}_n$, arranged in parallel in the upper region of the liquid crystal panel 30, and a pixel matrix 34 provided in the lower region. The D-ICs $\mathbf{32}_1$, to $\mathbf{32}_n$ divide pixels in the horizontal axis into 1/n units and drive them sequentially. In other words, each of the D-ICs $\mathbf{32}_1$, to $\mathbf{32}_n$ drives the pixels arranged successively.

The liquid crystal display apparatus further includes a data rearranging circuit 50 connected to first and second external buses FEB and SEB, respectively, and a block driver 52 connected between the data rearranging circuit 50 and the D-ICs $\mathbf{32}_1$, to $\mathbf{32}_n$. The data rearranging circuit 50 receives odd-numbered red, green and blue pixel data from the first external bus FEB and even-numbered red, green and blue pixel data from the second external bus SEB each time a clock period received from the clock input line CLK. The data rearranging circuit 50 sequentially rearranges the odd-numbered and the even-numbered pixel data to generate video data rearranged by the odd-numbered and even-numbered pixel data. The video data outputted from the data rearranging circuit 50 have a time period corresponding to half a period of the clock signal CLK.

The data rearranging circuit 50 has two latches 36 and 38, and a multiplexor 40 as shown in FIG. 4, or has two latches 36 and 38, a multiplexor 40 and a data synthesizer 42 as shown in FIG. 4.

The block driver 52 sequentially divides the rearranged video data from the data rearranging circuit 50 into equal parts based on the number of D-ICs, thereby dividing the same into n block data. Also, the block driver 52 commonly supplies the odd-numbered block data, via a first internal bus FIB, to the odd-numbered D-ICs($\mathbf{32}_1$ to $\mathbf{32}_3$, . . . , $\mathbf{32}_{n-1}$), and, at the same time, supplies the even-numbered block data, via a second internal bus SIB, to the even-numbered D-ICs ($\mathbf{32}_2$, $\mathbf{32}_4$, . . . , $\mathbf{32}_n$) The pixel data delivered through the first and the second internal buses FIB and SIB has a time period equal to that of the clock signal CLK. To this end, the block driver 52 increases by two times the period of pixel data. Then, each one of the odd-numbered D-ICs ($\mathbf{32}_1$, $\mathbf{32}_3$, . . . , $\mathbf{32}_{n-1}$) is sequentially driven to receive 1/n units of video data for one line, and divisionally drives the 1/n units of pixels for one line with the received video data. At the same time, each one of the even-numbered D-ICs ($\mathbf{32}_2$, $\mathbf{32}_4$, . . . , $\mathbf{32}_n$) is sequentially driven to receive 1/n units of the video data for one line, and divisionally drives the 1/n units of pixels for one line with the received video data. For this function, the block driver 52 can comprise a memory for storing temporarily the rearranged video data from the data rearranging circuit 50.

As described above, in a liquid crystal display apparatus according to the second embodiment of the present invention, the odd-numbered pixel data and the even-numbered pixel data are sequentially rearranged by means of two latches and a multiplexor and the rearranged pixel data are distributed and supplied to the odd-numbered and the even-numbered D-ICs hence driving the successively arranged pixels, thereby allowing the D-ICs to divide and drive pixels for one line sequentially in a predetermined number of units. Accordingly, the apparatus is capable of simplifying the wiring between the pixel matrix and the D-ICs as well as relatively enlarging the effective display area, that is, the area occupied by the pixel matrix. In other words, in the apparatus, it becomes possible to reduce the size of liquid crystal panel. Further, the liquid crystal display apparatus according to the second embodiment of the present invention can process video data at a faster speed than the liquid crystal display apparatus as shown in FIG. 4.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A liquid crystal display apparatus comprising:

a pixel matrix having pixels arranged in a liquid crystal panel;

first input means for sequentially receiving odd-numbered pixel data to be displayed on odd-numbered pixels in the pixel matrix;

second input means for sequentially receiving even-numbered pixel data to be displayed on even-numbered pixels in the pixel matrix;

a plurality of driving circuits for driving the pixels contained in the pixel matrix each of said driving circuits controlling a predetermined number of consecutive pixels in the pixel matrix; and rearranging means for alternately receiving the odd-numbered pixel data from the first input means and the even-numbered pixel data from the second input means, and for supplying the consecutive pixel data to the plurality of driving circuits, wherein the plurality of driving circuits are driven in sequence to receive the consecutive pixel data from the rearranging means in the predetermined number of pixel units.

2. A liquid crystal display apparatus of claim 1, wherein said rearranging means includes a multiplexor for alternately transferring the odd-numbered pixel data from the first input means and the even-numbered pixel data from the second input means to the plurality of driving circuits.

3. A liquid crystal display apparatus of claim 2, wherein said rearranging means further includes:

a first latch connected between the first input means and the multiplexor, wherein the first latch stores the odd-numbered pixel data; and a second latch connected between the second input means and the multiplexor, wherein the second latch stores the even-numbered pixel data.

4. A liquid crystal display apparatus of claim 2, wherein said rearranging means further includes synthesizing means connected between the multiplexor and the plurality of driving circuits, wherein the synthesizing means transfers the consecutive pixel data from the multiplexor to the plurality of driving circuits in response to a synchronous signal.

5. A liquid crystal display apparatus for use with a first input signal comprising odd pixel data and a second input signal comprising even pixel data, the liquid crystal display comprising:

a pixel matrix having odd-numbered pixels and even-numbered pixels;

a plurality of driving circuits, each one of the driving circuits controlling a predetermined number of consecutive pixels in the pixel matrix; and a data rearranging circuit receiving the first input signal and the second input signal, the data rearranging circuit rearranging the odd pixel data and the even pixel data and supplying an output signal comprising consecutive pixel data to the plurality of driving circuits;

wherein the plurality of driving circuits are sequentially driven to receive the consecutive pixel data from the rearranging means in the predetermined number of pixel units.

6. A liquid crystal display apparatus of claim 5, wherein the data rearranging circuit includes a multiplexor for alternately transferring to the plurality of driving circuits the odd pixel data from the first input signal and the even pixel data from the second input signal in response to a clock signal.

7. A liquid crystal display apparatus of claim 6 wherein the multiplexor transfers odd pixel data to driving circuits connected to the odd-numbered pixels when the clock signal is at a first logic level and transfers even pixel data to driving circuits connected to the even-numbered pixels when the clock signal is at a second logic level.

8. A liquid crystal display apparatus of claim 6, wherein the data rearranging circuit further includes:

a first latch connected to the multiplexor to latch the odd pixel data; and a second latch connected to the multiplexor to latch the even pixel data.

9. A liquid crystal display apparatus of claim 6, wherein the data rearranging circuit further includes a data synthesizer connected between the multiplexor and the plurality of driving circuits, wherein the data synthesizer transfers the consecutive pixel data from the multiplexor to the plurality of driving circuits in response to a synchronous signal.

* * * * *